United States Patent [19]

Colli et al.

[11] Patent Number: 4,957,244

[45] Date of Patent: Sep. 18, 1990

[54] BOBBIN WINDING METHOD, AND DEVICES FOR IMPLEMENTING SAID METHOD

[75] Inventors: Luigi Colli; Roberto Badiali; Nereo Marangone, all of Pordenone, Italy

[73] Assignee: Savio S.p.A., Pordenone, Italy

[21] Appl. No.: 258,372

[22] Filed: Oct. 17, 1988

[30] Foreign Application Priority Data

Nov. 13, 1987 [IT] Italy ..... 22625 A/87

[51] Int. Cl.[5] ..... B65H 54/22

[52] U.S. Cl. ..... 242/35.6 OR

[58] Field of Search ..... 242/35.6, 35.5 R, 35.5 A, 242/35.6 R, 36, 39; 57/263

[56] References Cited

U.S. PATENT DOCUMENTS 3,988,879 11/1976 Franzolini et al. ..... 57/34 R
4,163,358 8/1979 Takeuchi et al. ..... 57/78
4,195,790 4/1980 Reiners et al. ..... 242/35.6 R X
4,228,642 10/1980 Dakin et al. ..... 57/263
4,319,720 3/1982 Ueda ..... 242/35.6 R X

FOREIGN PATENT DOCUMENTS 2060003 4/1981 United Kingdom .

*Primary Examiner*—Stanley N. Gilreath
*Attorney, Agent, or Firm*—Hedman, Gibson, Costigan & Hoare

[57] ABSTRACT

A high-productivity bobbin winding method comprising a variable-duration intervention cycle for restoring yarn continuity. The cycle is divided into two parts, of which a first part is devoted to braking the bobbin and a second part is devoted to joining the yarn, between the commencement of the two parts there being interposed a delay which varies as a function of the time measured for the bobbin to come to rest during the preceding intervention cycle. By reducing the stoppage time for rejoining the disconnected yarn, unproductive time during the winding operation is shortened.

14 Claims, 6 Drawing Sheets

DEVELOPMENT OF STOPPAGE TIMES AT CONSTANT WINDING SPEED FOR DIFFERENT YARN COUNTS

DEVELOPMENT OF STOPPAGE TIMES AT CONSTANT YARN COUNT AND DIFFERENT WINDING SPEEDS

BOBBIN WINDING METHOD, AND DEVICES FOR IMPLEMENTING SAID METHOD

This application is related to commonly assigned applications by Luigi Colli et al. for Improved Method of Restoring Yarn Continuity During Bobbin Winding and Devices For Its Implementation, Ser. No. 246,411, filed Sept. 19, 1988; Improved Bobbin Method Comprising Variable Duration Interventions For Restoring Yarn Continuity and Devices For Its Implementation, Ser. No. 254,406, filed Oct. 6, 1988; and High Productivity Bobbin Winding Method And Devices For Its Implementation, Ser. No. 256,776, filed Oct. 11, 1988.

FIELD OF THE INVENTION

This invention relates to an improved winding method and devices for implementing said improved method.

The improvement according to the invention enables the productivity of the winding operation to be increased and unproductive times to be eliminated or shortened.

BACKGROUND OF THE INVENTION

The winding operation consists substantially of transferring the yarn from a starting package and winding it on a rigid tube in order to form a structure wound in the form of cross turns and known as a bobbin, and during said transfer clearing the yarn of its imperfections and defects such as lumps, groups, naps, weak points, flocks etc. Said defects are eliminated by cutting out the defective portion and joining the yarn ends.

This joint can be made either by a proper knot such as a fishermans knot or a weavers knot produced by a mechanical knotter, or by a pneumatic or friction joint in which the fibres of the cut ends are untwisted, intermixed and then retwisted to thus restore continuity to the cut yarn without introducing the negligible irregularity represented by an actual knot.

The removal of yarn defects is commonly known as yarn clearing in that the defect is detected by a yarn clearer which is sensitive to yarn defects and can either itself break the continuity of the yarn or operate a separate cutting member.

Any discontinuity in the yarn causes the bobbin to undergo braking so that it stops, the yarn ends are picked up by mobile suckers and moved to the joining devices or knotters, the joined yarn is returned to its normal position and winding is recommenced, the bobbin and its drive roller being driven up from rest to the operating speed, which is generally of 600–1600 m/minute. The winding speed is determined—within the limits of the possible winding machine performance—by the quality and count of the yarn to be wound.

The overall productivity of the operation is determined by the winding speed, the time taken by the overall intervention cycle and the actual number of interventions to be made.

It is therefore apparent that if a certain yarn is wound at a too high a speed, the increased productivity resulting from the increase in speed is compromised by the down times deriving from the increase in the number of interventions required to restore the yarn continuity due to the greater number of yarn breakages. The bobbin is normally driven by a rotating roller—of right cylindrical or slightly tapering conical shape—which is kept in contact along a generator common to the two members.

The technical problem to which the present invention relates derives from the fact that during the winding operation the rotating roller does not change its shape or size, whereas the bobbin continually changes its size due to the increasing amount of yarn wound on it.

If the drive takes place under perfect friction, the peripheral speed of the drive roller is substantially equal to the linear winding speed of the yarn.

The yarn is guided so that it winds on the bobbin in a spiral arrangement using a yarn guide of various shapes or spiral grooves formed in the surface of the driving roller, in which the yarn engages.

By the action of such devices, the yarn is distributed over the bobbin surface by means of periodical travel along the bobbin generator.

The closer together the turns, the more dense is the bobbin and vice versa.

As the size of the bobbin increases, the linear yarn winding speed is kept substantially constant—this being a necessary condition for proper outcome of the operation—but the angular speed of the bobbin decreases linearly.

As the yarn travels along the contact generator in constant time, the number of turns wound for each travel stroke of the yarn guide reduces slightly but continuously for each wound layer.

As the bobbin forms it acquires an ever increasing inertia because of the increase in mass and its progressive distancing from the axis of rotation.

The first stage in the intervention cycle which commences with the cutting or breaking of the yarn by the passage of a defective portion through the yarn clearer is the braking of the bobbin so that its speed decreases to zero.

The brake must therefore absorb the kinetic energy possessed by the rotating bobbin, and its stopping time is substantially proportional to said kinetic energy.

Generally, the bobbin is braked by a mechanical shoe brake—or equivalent type—operated by pressurised fluid such as compressed air, which is distributed by a solenoid valve which operates following the yarn discontinuity signal.

The drive roller is provided with its own braking devices, such as an inverter acting on its drive motor. To prevent damage to the bobbin it is desirable that the two braking actions take place independently, by withdrawing the bobbin and roller away from each other when the yarn discontinuity signal occurs and at the commencement of the intervention cycle.

The operations subsequent to the stoppage can take place only when the bobbin is at rest.

In the known art the intervention cycle is effected as shown in the scheme of FIG. 1.

The duration of the intervention cycle is fixed and is divided into a fixed time available for stoppage and a fixed time for executing the other operations to be carried out during the intervention. After the stoppage time has passed, the bobbin must be completely at rest because otherwise the other intervention operations cannot be properly carried out, for instance it would be impossible to grip the end of the yarn on the bobbin side if this is still rotating.

The drive and control unit for the members which sequentially carry out the various operations of the intervention cycle is a mechanical system—such as a shaft provided with a series of cams so that when rotated, said cams sequentially encounter the drives for the various members, which consequently operate in sequence—or an equivalent electrical control system.

In this arrangement, the various intervention operations are performed sequentially by various members operated in accordance with a program of operation initiation times which are rigid and cannot be changed.

To be more precise, it should be noted that certain preliminary operations, such as moving the suckers into the correct position for seeking and picking up the yarn ends, these suckers being in their rest position at the commencement of the intervention cycle, can commence while the bobbin is still moving, but the actual operations of the intervention cycle subsequent to braking can only commence when the bobbin is properly at rest.

If the bobbins to be produced are small or if the operating speed is low, the time taken by those preliminary operations which can be carried out while the bobbin is still moving is longer than the bobbin stoppage time, and there are therefore no problems.

The fixed time allowed for bobbin stoppage must therefore correspond to the time required for absorbing the maximum kinetic energy which the bobbin can possess, and thus to its maximum possible winding speed, its maximum possible size and its maximum possible density. This time must then be increased by a certain safety margin to take account of any reduction in the efficiency of the braking system.

The current tendency in bobbin production is to increase winding speed and to maintain it when producing large-diameter bobbins. It is apparent that the criterion of assigning a fixed available time for bobbin stoppage based on the maximum kinetic energy which it can assume leads in most cases to a considerable time wastage because this fixed assigned time is necessary only when the bobbin has reached its maximum scheduled size and rotates at the maximum speed scheduled for this size.

This is very important because this time wastage—even if only of the order of a few seconds—is repeated during every intervention cycle for restoring yarn continuity, and this cycle can take place hundreds of times.

The deriving technical problem which the present invention solves is to assign a bobbin stoppage time within the intervention cycle which is no longer fixed but is variable, and corresponds substantially to the time which the braking device would require at any given moment to bring the bobbin to rest, this time depending on the kinetic energy of the bobbin at the moment of this operation.

SUMMARY OF THE INVENTION

The present invention consists therefore of an improved winding method and devices for itsimplementation. It consists of three essential component parts:

dividing the intervention cycle—and the control devices which implement it—into two seperate parts, a first part for at least braking and stopping the bobbin and directly related to the discontinuity in the wound yarn (and hereinafter called simply braking) and a second part for at least the further stages of the intervention cycle which have to be carried out when the bobbin is at rest (and hereinafter called simply joining), and interposing between the commencement of the stages involved in the two parts a variable delay which is to be determined at any given time, and is implemented by a timer device which controls the commencement of joining with a time displacement corresponding to said delay;

measuring the state of progress in the formation of the bobbin and transmitting this to the unit for identifying the delay to be assigned;

identifying the delay to be assigned at any given time on the basis of the state of progress in the formation of the bobbin and transmitting this to the timer device which implements this delay between the commencement of braking and the commencement of joining.

DESCRIPTION OF THE DRAWINGS

FIG. 7 is a diagram of the control logic of the present invention.

DESCRIPTION OF THE PREFERRED EMBODIMENT

Before describing in detail the three aforesaid essential parts of the invention, some introductory considerations are necessary. Mechanical bobbin braking systems exert a practically constant braking torque as the speed varies, and consequently the time required to halt the bobbin is essentially proportional to the bobbin kinetic energy.

The time required for halting the bobbin is therefore unequivocally determined by its state of progress—once the braking torque of the braking device is known.

The bobbin stoppage time, and the kinetic energy which it possesses, depend therefore both on initially assigned parameters, namely:

yarn count initial tube suze manner in which the yarn guide undergoes its travel strokes peripheral speed of the drive roller (which is substantially equal to the linear winding speed), which do not vary as the bobbin progresses, and also on the actual bobbin progress itself.

This can be measured by the number of revolutions undergone by the roller from the commencement of formation of the bobbin, or by the length of yarn already wound on it, or by the useful time which has passed from the commencement of its formation. These three indications of the state of progress are all equivalent to each other as they are related by strictly linear relationships.

A further indication of the state of progress of the bobbin is the number of revolutions undergone by the bobbin from the commencement of its formation. This indication is a a function of the preceding but not in accordance with a linear relationship as the angular speed of the bobbin decreases with increase in its diameter.

Figure 1:
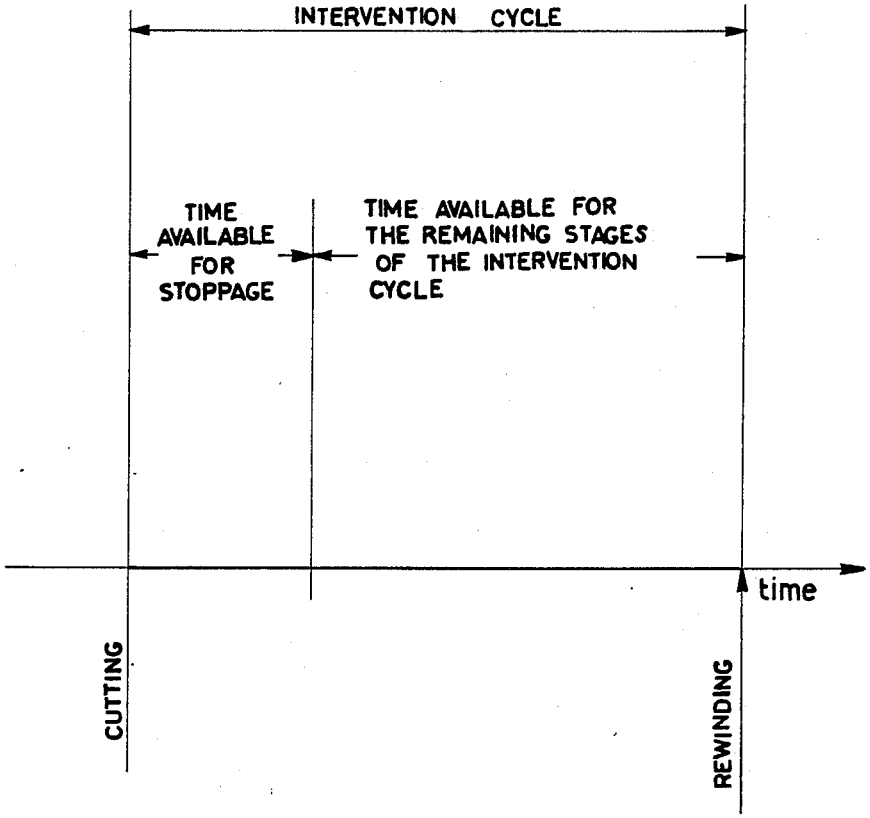
Fig.1 PRIOR ART
FIG. 1 is a graphical illustration of the prior art.
Figure 2A:
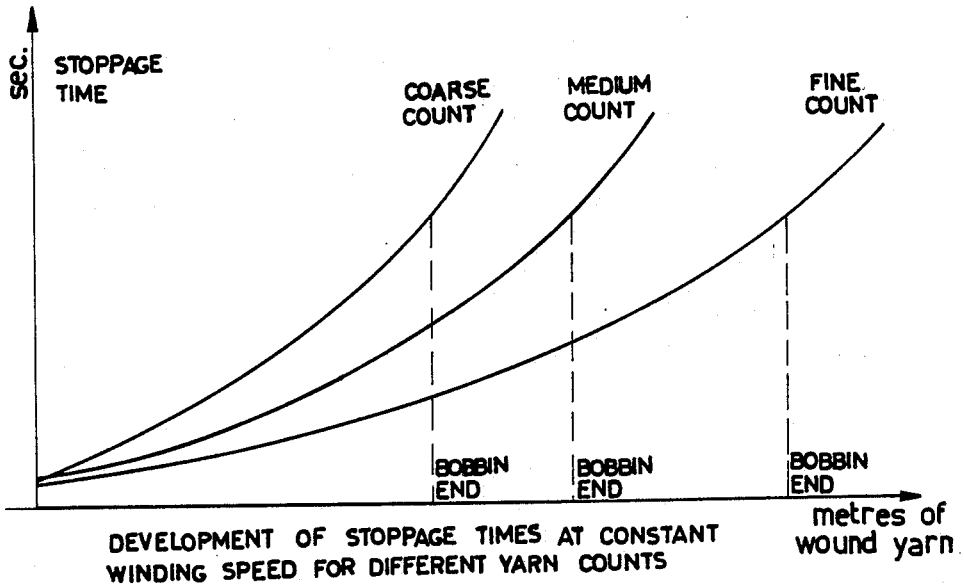
FIG. 2 is a graphical representation of bobbin stoppage times relative to the amount of yarn on the bobbin.
Figure 2B:
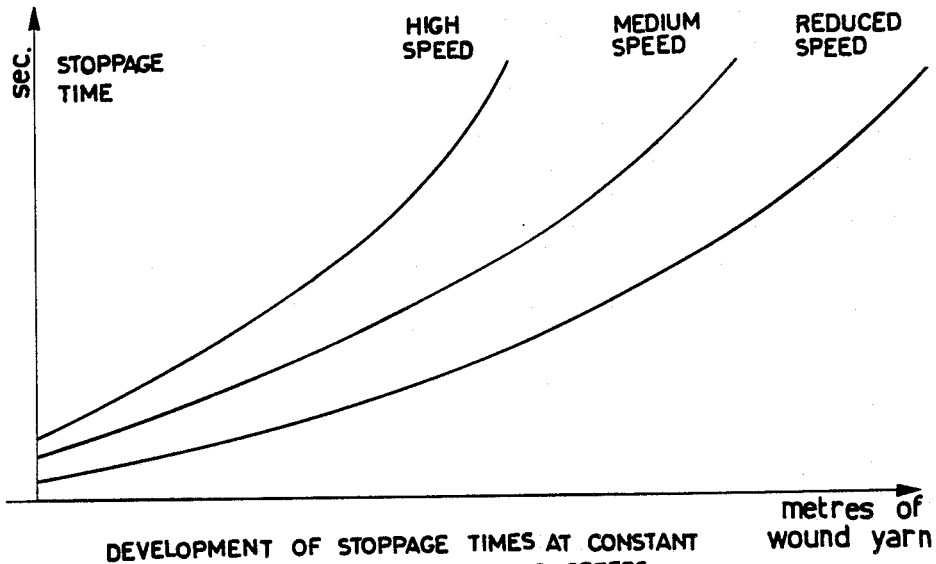

The variation in the time required for halting the bobbin as a function of the bobbin state of progress is shown in FIG. 2. Once the aforesaid winding parameters are known, this variation can be determined with good approximation and provides a reliable indication of the stoppage times for the bobbin under formation. The characteristics of the three essential parts of the present invention will now be described, commencing from the division of the intervention cycle and its control devices.

The first part of the intervention cycle, which commences on receipt of a signal indicating yarn discontinuity—either because it has been cut intentionally by the yarn clearer, or because it has broken naturally or because the feed package is empty—consists of the following main stages:

raising the bobbin away from the drive drum
braking the bobbin
braking the drive roller.

All these three operations are related to each other and are controlled either electrically, for example by means of a solenoid valve operating with compressed air, or mechanically by means of a rotary shaft provided with cams. The various operations concerned and the devices which implement them proceed without rigid time relationship with the second part of the intervention cycle. The second part of the intervention cycle can commence either simultaneously with the first—if no delay instruction has been transmitted by the delay identification unit—or with a delay in accordance with the instructions from said delay identification unit. The second part of the intervention cycle consists of the following main stages:

moving the suckers which seize the yarn ends on the bobbin side and package side;
sensing the presence of yarn;
if there is no yarn present on the package side, operating the package changing devices and, when the package has been changed, seizing the new yarn end on the package size;
disenabling the command which has implemented the first part of the cycle; the brakes are released, and the bobbin and roller are again brought into contact;
reversing the motion of the drive roller for a short time to allow the sucker which seizes the yarn end on the bobbin side to operate with a sufficient length of yarn to reach the knotter;
inserting the yarn ends into the knotter;
operating the knotter to make the joint and then releasing the joined yarn (in the meantime the yarn seizing suckers can return to their rest position);
restarting the drive roller.

These stages of the second part can also be controlled mechanically, such as by a rotary shaft provided with a series of cams which gradually operate the controls for the devices implementing the aforesaid steps, or by equivalent electrical or electronic devices.

The state of progress of the bobbin under formation is measured in the following manner.

It is preferably done by measuring with a revolution contour the number of revolutions undergone by the drive roller or the length of yarn wound on the bobbin—this being substantially equal to the the number of revolutions undergone by the roller multiplied by its circumference—or by measuring the useful winding time, by means for example of a time measurement device after setting it to zero at the commencement of a new bobbin.

Other indications of the state of progress of the bobbin under formation can be the number of revolutions undergone by the bobbin, the ratio of the number of revolutions undergone by the bobbin to the number of revolutions undergone by the roller, the angular speed of the bobbin, its radius and so on.

The measured value of the bobbin state of progress is expressed in analog or digital form and fed to the unit for identifying the delay to be assigned.

The identification of the delay to be assigned is determined in the following manner.

It will be assumed that a progressively increasing series of times are to be left available for bobbin stoppage.

For example, the following time series can be set:

2 seconds (not less than the time occupied by the preliminary operations which can be carried out while the bobbin is still moving),
3 seconds corresponding to a delay of 1 second,
4 seconds corresponding to a delay of 2 seconds,
5 seconds corresponding to a delay of 3 seconds,
6 seconds corresponding to a delay of 4 seconds, and so on.

Figure 3:
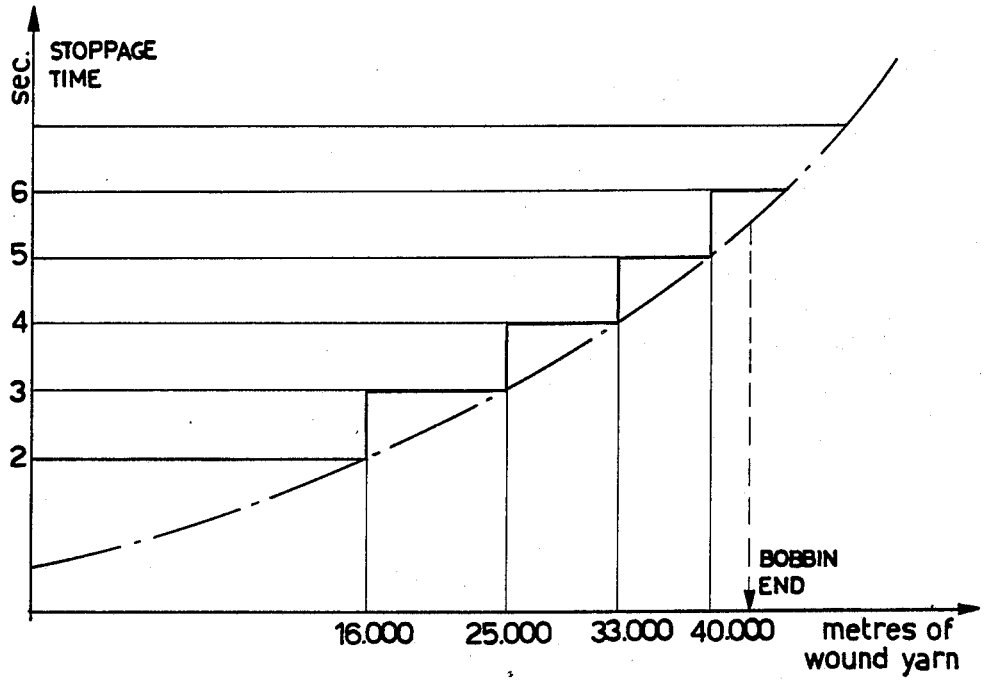
FIG. 3 is an orthogonal representation of the arrangement of the bobbin carrier arm and the drive roller.

This series of times, or delays, is set as a series of values to be assigned by the identification unit. In the production of a determined bobbin of which all the winding parameters are known, namely:

yarn count
initial tube size
length of travel of the yarn guide and its frequency
winding speed
final state of progress, there will be a certain shape of the curve relating bobbin state of progress to stoppage time, such as that shown in FIG. 3. Each term in the aforesaid example series of time corresponds to a term in the state of progress series (for example to a certain collected yarn length).

For that particular winding operation, the following stoppage time must for example be left available; for up to 16,000 meters of wound yarn a stoppage time of 2 seconds, from 16,000 to 25,000 meters of wound yarn a stoppage time of 3 seconds, from 25,000 to 33,000 meters of yarn a stoppage time of 4 seconds, from 33,000 to 40,000 meters of yarn a stoppage time of 5 seconds. It is apparent that the closer together the terms of the series of stoppage time the closer the approximation obtained by the stepped line to the actual stoppage time curve. The use of any safety margins corresponds to displacing the stepped line of FIG. 3 towards the left.

The delay identification unit therefore contains a set of data relating to the winding parameters as shown in Table 1 by way of example.

These data must be fed to the memory of the identification unit before commencing work in accordance with these winding parameters.

The identification unit receives either continuously or at discrete time intervals data regarding the bobbin state of progress and compares these with the values of the state of progress/delay series.

Assuming for example yarn of count X is being wound, with a yarn guide travel stroke of Y and winding speed 1200 m/minute, then if the bobbin state of progress exceeds $h_0$ meters the identification unit sets the delay value at 1 second in the timer provided between the two parts of the intervention cycle control unit (so increasing the time available for stoppage to 3 seconds); if the bobbin state of progress exceeds $h_1$ meters the identification unit sets the delay value to 2 seconds, and so on.

In practice, this set of values is fed into the memory of the processor on the machine.

The characteristics and advantages of the present invention will be more apparent from the descripton of a typical embodiment given hereinafter with reference to FIGS. 4, 5 and 6.

Figure 4:
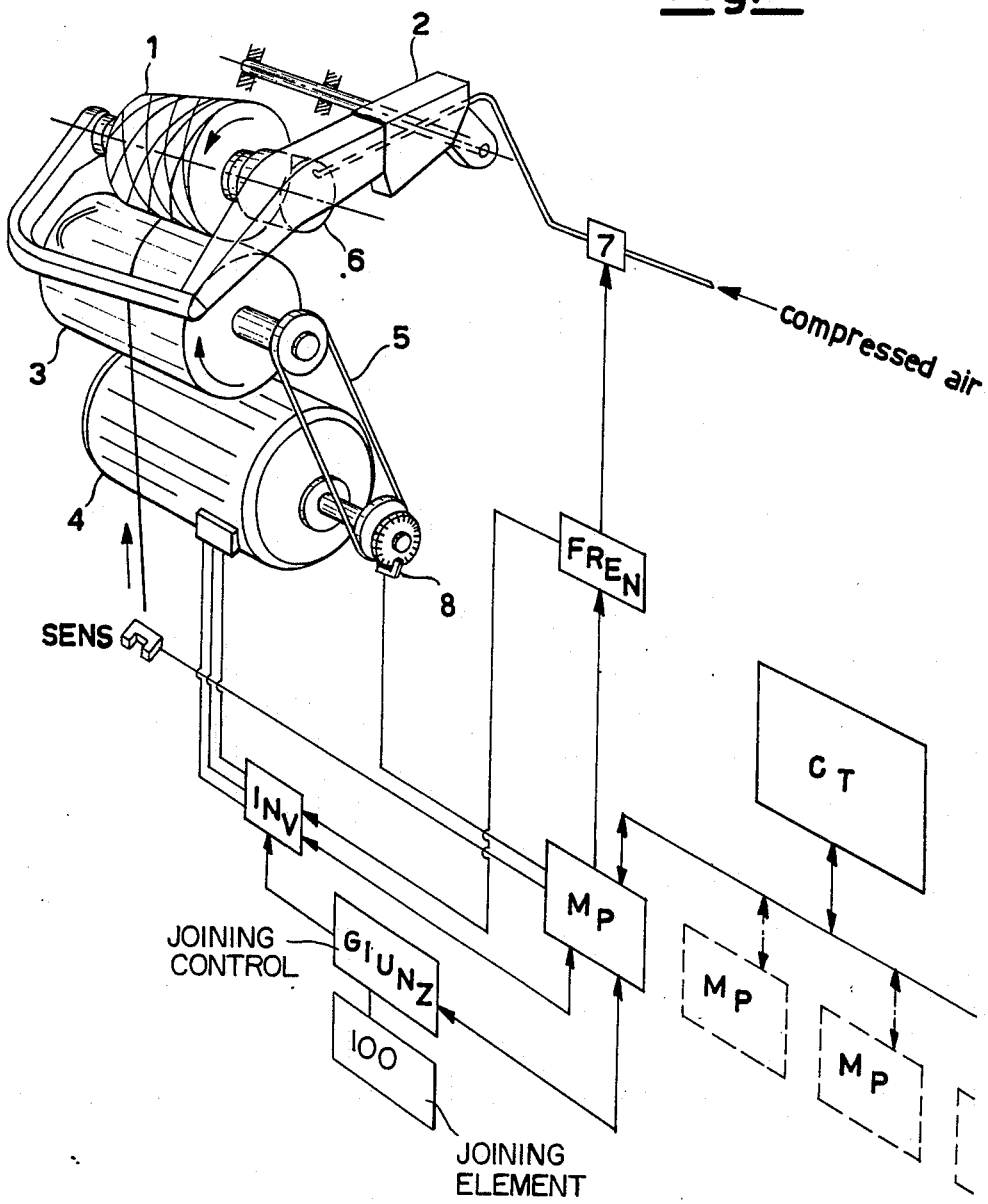
FIG. 4 is an orthogonal representation of the present invention including the control signals of the microprocessor.

FIG. 4 shows a typical arrangement of the invention. The bobbin 1 under formation, the tube of which is engaged in the fixing centres of the bobbin carrier arm 2, rests against the roller 3 which rotates at constant speed driven by the motor 4 by way of a toothed belt drive 5. The bobbin 1 is therefore rotated by the roller 3 and winds the yarn about itself, its diameter increasing gradually.

A pneumatically operated brake 6, with its compressed air feed controlled by the solenoid valve 7, is installed on the bobbin carrier arm 2 for the purpose of braking the bobbin 1. On the shaft of the motor 4 there is installed a sensor 8 for measuring the number of revolutions undergone by the roller 3, and its speed.

Each winding station—commonly known as the winding head or simply head—is provided with a microprocessor connected to the machine processor or head computer CT; said microprocessor is connected to the following: to the brake control FREN which operates the brake 6 by the solenoid valve 7 and operates the other members which implement the braking cycle; to the sensor 8, from which it obtains the length of yarn wound by processing the signal obtained by the sensor 8 itself; to the yarn sensor SENS which, when it detects a yarn discontinuity, feeds to MP the intervention cycle initiation signal; to the inverter INV to which it feeds stop and start signals for the motor 4 and thus for the roller 3; and to the joining control GIUNZ which sequentially activates the various members which implement the joining cycle by means of joining element 100 and removes the brake applied to the motor by the inverter. The delays with which GIUNZ is activated are determined by a timer device incorporated in the microprocessor MP but not indicated on the figure.

Figure 5:
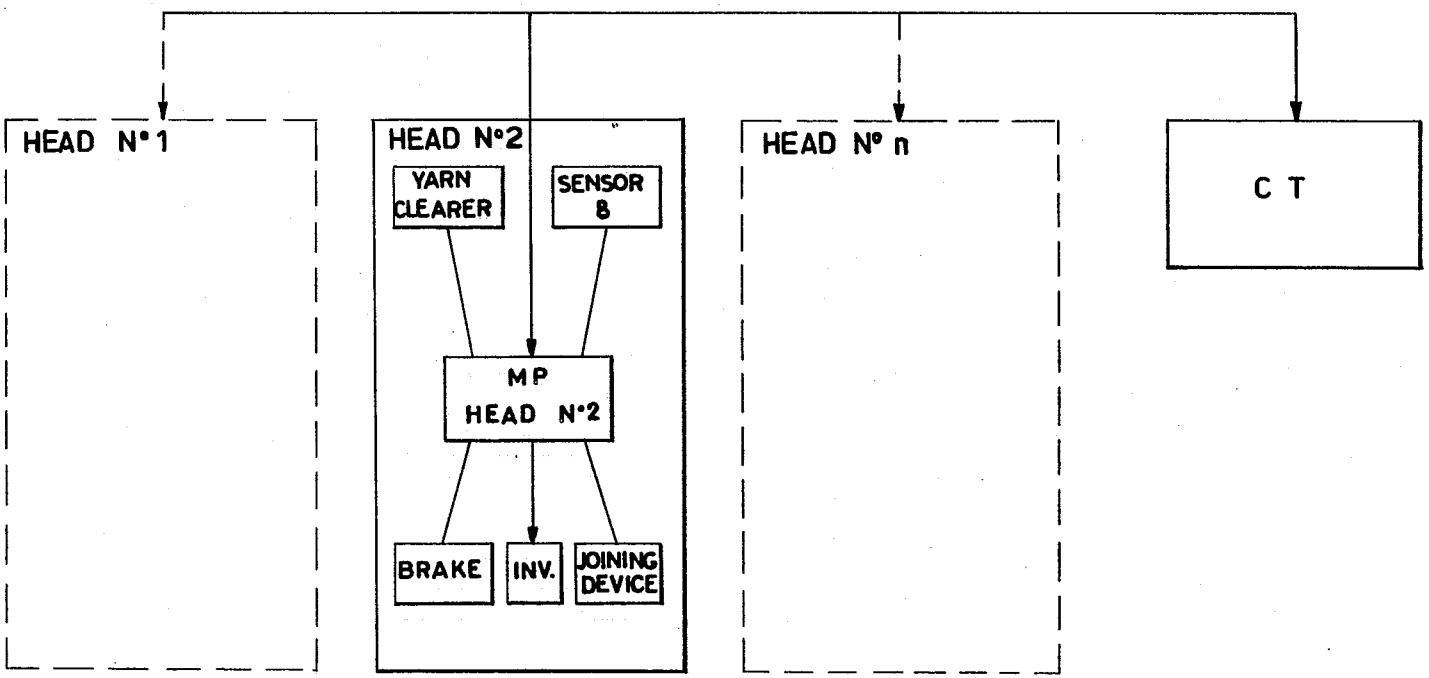
FIG. 5 is a diagrammatic depiction of the logic circuit.
Figure 6:
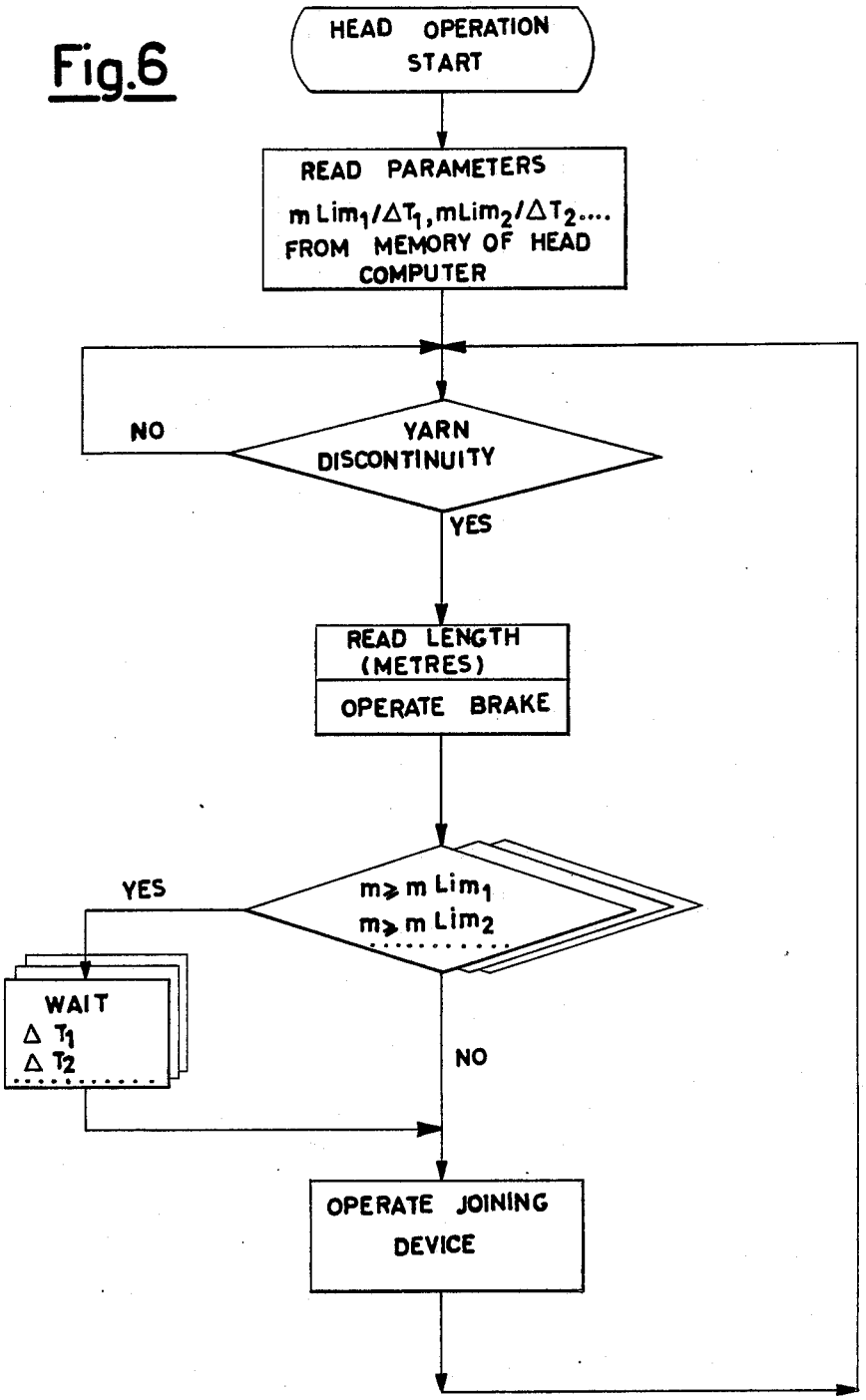
FIG. 6 is a graphical representation of the function of stoppage times relative to bobbin diameter.

This scheme is shown in FIG. 5. The logic diagram for the method is shown in FIG. 6, and is described hereinafter together with the commands executed.

The CT memories contain the parameters for the delays $\Delta t_1$, $\Delta t_2$ . . . as a function of the yarn length $m_{lim1}$, $m_{lim2}$, . . . in accordance with the example given in Table 1. These yarn length limits can be calculated or determined on sample bobbins and are a function of the winding speed, the yan count, the bobbin radius and its density.

At each commencement of formation of a new bobbin, the microprocessor of the winding head concerned reads these pairs of values.

At each yarn discontinuity the bobbin/roller assembly is braked, each independently by its own brake, and the length m of yarn already wound on the bobbin is measured. This value is compared in sequence with the series of values $m_{lim1}$, $m_{lim2}$ . . . to find the minimum value of $m_{lim}$ which still exceeds the measured m, and the corresponding delay $\Delta t$ is used.

The microprocessor is not required to compute but only to make a series of comparisons between the yarn length measured at the moment of the break in continuity of the yarn and the memorised series of $m_{lim}$ values.

Up to this point of the description we have for simplicity described an embodiment based on the operating criterion of fixing the increasing terms of the series of times left available for braking the bobbin—or of the corresponding series of delays between the commencement of braking and the commencement of joining—but varying, in accordance with the bobbin winding parameters, the series of limiting states of progress beyond which the delay has to be incremented by a predetermined step. Thus in the diagram of FIG. 3 a staircase arrangement is obtained with its steps having fixed "rise" values and variable "tread" values. For correct understanding of the invention it should however be noted that this can also be attained by the opposite operating criterion. This consists of fixing the series of limiting state of progress values beyond which the time allowed for braking—or the delay between the commencement of braking and the commencement of joining—but varying the terms of the increasing series of times left available for braking—or of the corresponding series of delays.

Thus in the diagram of FIG. 3 a staircase arrangement would be obtained with its steps having fixed "rise" values and variable "tread" values.

The advantages obtained by the present invention are apparent from the aforegoing description, namely:

- the possibility of varying the time available for bobbin braking means that winding can proceed at higher speeds and/or larger diameter bobbins can be wound without extending said braking time beyond that strictly necessary;
- any efficiency loss in the bobbin brakes with the passing of time can be compensated by varying the series of $m_{lim}$ values and/or the series of times available for stoppage;
- the winding speed and/or the diameter of the bobbins produced can be varied without modifying the machine, but merely by modifying the data stored in the machine processor memories;

The following table illustrates the variable used by the logic circuitry to determne the progress of the wound bobbin in order to produce the shorten stoppage times of the present invention.

TABLE 1

| | | | |
|---|---|---|---|
| Yarn count: | X | | |
| Yarn guide travel stroke: | Y | | |
| . . . : | . . . | | |
| Winding speed | 800 | 1200 | 1600 m/min |
| 0 seconds up to | $a_0$ | $h_0$ | $l_0$ |
| 1 second up to | $a_1$ | $h_1$ | $l_1$ |
| 2 seconds up to | $a_2$ | $h_2$ | $l_2$ |
| delay | | | |
| 3 seconds | end of bobbin | $h_3$ | $l_3$ |
| 4 seconds | — | $h_4$ | $l_4$ |
| . . . | — | end of bobbin . . . | |
| n. seconds | — | | $l_n$ |

We claim:

1. A method for winding yarn onto a rotating bobbin driven by a drive roller and supported by a carrier arm when the yarn feed is broken, comprising:

(a) restoring the broken yarn feed by means of an intervention cycle wherein said cycle has a first portion and a second portion wherein said first portion comprises the steps of:

(1) raising the rotating bobbin from the drive roller when the yarn feed is broken;

(2) braking the rotating bobbin and the drive roller independently until the bobbin stops rotating wherein the rotating bobbin is braked when it is separated from the drive roller;

and wherein said second portion comprises joining the broken yarn; and (b) interposing a variable time delay between the commencement of said bobbin braking step of said first portion and the commencement of said joining step of said second portion of said intervention cycle by means of a timer device wherein said variable time delay is determined by the amount of yarn wound on the bobbin, wherein the amount of yarn wound on the bobbin is determined by measuring the revolutions of the drive roller from the commencement of bobbin winding by a counter means.

2. The method of claim1 further comprising:

(a) comparing the amount of yarn wound onto the bobbin with a series of delay limiting values by means of a control unit; and (b) sending delay instructions to said timer device by means of said control unit.

3. The method of claim 2 wherein said series of delay limiting values comprise a discrete series of increasing time delay limiting values.

4. The method of claim 3 wherein zero is the first value of said discrete series of increasing time delay limiting values.

5. The method of claim 4 further comprising:

(a) modifying said series of delay limiting values by a computer means;

(b) feeding said modified values to a microprocessor means by said computer means.

6. A device for winding yarn onto a rotating bobbin driven by a drive roller and supported by a carrier arm when yarn feed is broken, comprising:

(a) a bobbin raising means for raising the rotating bobbin from the drive roller when the yarn feed is broken;

(b) a bobbin braking means for braking the rotating bobbin when it separates from the drive roller until the bobbin stops rotating;

(c) a drive roller braking means for braking the drive roller independently from said bobbin braking means;

(d) a joining means to join the broken yarn; and (e) a timer device for interposing a variable time delay between the commencement of the operation of said bobbin braking means and the commencement of the operation of said joining means wherein said time delay is determined by the amount of yarn wound on the bobbin wherein the amount of yarn wound on the bobbin is determined by a counter for measuring the number of revolutions of the drive roller from the commencement of bobbin winding.

7. The device of 6 further comprising at least one microprocessor for comparing the amount of yarn wound onto the bobbin with a series of limiting length values and wherein said microprocessor sets said variable delay value from said series of limiting length values at a value greater than the length of yarn wound onto the bobbin.

8. A method for winding yarn onto a rotating bobbin driven by a drive roller and supported by a carrier arm when yarn feed is broken, comprising:

(a) restoring the broken yarn feed by means of an intervention cycle wherein said cycle has a first portion and a second portion wherein said first portion comprises the steps of:

(1) raising the rotating bobbin from the drive roller when the yarn feed is broken;

(2) braking the rotating bobbin and the drive roller independently until the bobbin stops rotating; and wherein said second portion comprises joining the broken yarn; and (b) interposing a variable time delay between the commencement of said bobbin braking step of said first portion and the commencement of said joining step of said second portion of said intervention cycle by means of a timer device wherein said variable time delay is determined by the amount of yarn wound on the bobbin, wherein the amount of yarn wound on the bobbin is determined by measuring the elapsed time of bobbin winding by a timing means.

9. The method of claim 8 further comprising:

(a) comparing the amount of yarn wound onto the bobbin with a series of delay limiting values by means of a control unit; and (b) sending delay instructions to said timer device by means of said control unit.

10. The method of claim 9 wherein said series of delay limiting values comprise a discrete series of increasing time delay limiting values.

11. The method of claim 10 wherein zero is the first value of said discrete series of increasing time delay limiting values.

12. The method of claim 11 further comprising:

(a) modifying said series of delay limiting values by a computer means;

(b) feeding said modified values to a microprocessor means by said computer means.

13. A device for winding yarn onto a rotating bobbin driven by a drive roller and supported by a carrier arm when yarn feed is broken, comprising:

(a) a bobbin raising means for raising the rotating bobbin from the drive roller when the yarn feed is broken;

(b) a bobbin braking means for braking the rotating bobbin when it separates from the drive roller until the bobbin stops rotating;

(c) a drive roller braking means for braking the drive roller independently from said bobbin braking means;

(d) a joining means to join the broken yarn; and (e) a timer device for interposing a variable time delay between the commencement of the operation of said bobbin braking means and the commencement of the operation of said joining means wherein said time delay is determined by the amount of yarn wound on the bobbin wherein the amount of yarn wound on the bobbin is determined by a timer means for measuring the amount of time elapsed during bobbin winding.

14. The device of claim 13 further comprising at least one microprocessor for comparing the amount of yarn wound onto the bobbin with a series of limiting length values and wherein said microprocessor sets said variable delay value from said series of limiting length values at a value greater than the length of yarn wound onto the bobbin.

* * * * *